US011605498B2

(12) United States Patent
Kazuta et al.

(10) Patent No.: US 11,605,498 B2
(45) Date of Patent: Mar. 14, 2023

(54) MULTILAYER COIL COMPONENT

(71) Applicant: TDK CORPORATION, Tokyo (JP)

(72) Inventors: Youichi Kazuta, Tokyo (JP); Kazuya Tobita, Tokyo (JP); Yuto Shiga, Tokyo (JP); Noriaki Hamachi, Tokyo (JP)

(73) Assignee: TDK CORPORATION, Tokyo (JP)

( * ) Notice: Subject to any disclaimer, the term of this patent is extended or adjusted under 35 U.S.C. 154(b) by 327 days.

(21) Appl. No.: 16/930,692

(22) Filed: Jul. 16, 2020

(65) Prior Publication Data

US 2021/0020357 A1 Jan. 21, 2021

(30) Foreign Application Priority Data

Jul. 19, 2019 (JP) ..... JP2019-133935

(51) Int. Cl.
*H01F 27/29* (2006.01)
*H01F 17/00* (2006.01)

(52) U.S. Cl.
CPC ..... *H01F 27/292* (2013.01); *H01F 17/0013* (2013.01)

(58) Field of Classification Search
CPC ..... H01F 27/292; H01F 17/0013; H01F 27/29
See application file for complete search history.

(56) References Cited

U.S. PATENT DOCUMENTS 11,217,372 B2 * 1/2022 Jung ..... H01F 27/2804
2008/0257488 A1 * 10/2008 Yamano ..... H01F 41/00 156/274.2
2013/0093556 A1 * 4/2013 Lim ..... H01F 17/0013 336/200
2017/0103848 A1 * 4/2017 Yoneda ..... H01F 17/0013
2017/0133146 A1 * 5/2017 Lee ..... H01F 41/042
2017/0256352 A1 * 9/2017 Kido ..... H01F 27/2804
2017/0352467 A1 * 12/2017 Kakiuchi ..... H01F 27/29
2018/0068780 A1 * 3/2018 Shimoda ..... H01F 17/0013
2019/0066905 A1 * 2/2019 Hong ..... H01F 41/043
2019/0122808 A1 * 4/2019 Jo ..... H01F 17/02
2020/0083587 A1 * 3/2020 Matsushita ..... H01P 5/184
2020/0373065 A1 * 11/2020 Hirukawa ..... H01F 17/0013
2021/0407721 A1 * 12/2021 Shigematsu ..... H01F 17/0006

FOREIGN PATENT DOCUMENTS

CN 106252025 A * 12/2016 ..... H01F 17/0013
JP 2017-073536 A 4/2017

* cited by examiner

*Primary Examiner* — Elvin G Enad
*Assistant Examiner* — Malcolm Barnes
(74) *Attorney, Agent, or Firm* — Oliff PLC

(57) ABSTRACT

A multilayer coil component includes an element body, a coil, and a pair of terminal electrodes. Each of the pair of terminal electrodes is formed by a plurality of electrode layers having different shapes being stacked in a stacking direction and is exposed on end surfaces, a main surface, and a pair of side surfaces. One electrode part of the terminal electrodes exposed on the side surfaces of the element body and formed by one of the electrode layers has an overlapping part overlapping at least a part of the other electrode part formed by another of the electrode layers adjacent to the one electrode layer in the stacking direction and a non-overlapping part not overlapping the other electrode part when viewed from the stacking direction.

6 Claims, 11 Drawing Sheets

MULTILAYER COIL COMPONENT

TECHNICAL FIELD

The present invention relates to a multilayer coil component.

BACKGROUND

The multilayer coil component that is described in Patent Literature 1 (Japanese Unexamined Patent Publication No. 2017-73536) is known as an example of multilayer coil components of the related art. The multilayer coil component described in Patent Literature 1 includes an element body, a coil disposed in the element body and having a coil axis extending along the facing direction of a pair of side surfaces of the element body, and a pair of terminal electrodes embedded in the element body and disposed over the end and mounting surfaces of the element body.

SUMMARY

In the multilayer coil component, it is desired to increase the diameter of the coil in order to achieve an improvement in characteristics. However, an increase in the diameter of the coil in the configuration in which the terminal electrode is disposed in the element body results in a decrease in the distance between the terminal electrode and the coil. As a result, the stray capacitance (parasitic capacitance) that is formed by the coil and the terminal electrode increases and a problem arises in the form of a deterioration in characteristics. Accordingly, the terminal electrode has an L shape so that the distance between the coil and the terminal electrode is ensured as in the multilayer coil component of the related art.

In addition, in the multilayer coil component, a configuration can be adopted in which the terminal electrode can be exposed also on the side surface of the element body and solder can be formed also on the terminal electrode positioned on the side surface of the element body so that solder-based firm fixing is performed with respect to a circuit board or the like. A multilayer coil component having such a configuration is manufactured by stacking of a conductor pattern constituting a coil and an electrode layer constituting a terminal electrode. In a case where a plurality of the electrode layers have the same shape, it is difficult to ensure the area of a contact (facing) surface with the element body in each electrode layer. Accordingly, especially the outermost electrode layer that is exposed on the side surface of the element body as one of the plurality of electrode layers constituting the terminal electrode may peel off in a manufacturing process and a defect is likely to occur. Accordingly, a defect may occur in the formed terminal electrode.

An object of one aspect of the present invention is to provide a multilayer coil component that is capable of suppressing the occurrence of a defect in a terminal electrode.

A multilayer coil component according to one aspect of the present invention includes an element body having a plurality of stacked dielectric layers and having a pair of end surfaces facing each other, a pair of main surfaces facing each other, and a pair of side surfaces facing each other in a stacking direction of the plurality of dielectric layers, one of the main surfaces being a mounting surface, a coil disposed in the element body and having a coil axis extending along the stacking direction, and a pair of terminal electrodes connected to the coil and respectively embedded in the element body on the pair of end surface sides of the element body. Each of the pair of terminal electrodes is formed by a plurality of electrode layers having different shapes being stacked in the stacking direction and is exposed on the end surface, the mounting surface, and the pair of side surfaces, and one electrode part of the terminal electrode exposed on the side surface of the element body and formed by one of the electrode layers has an overlapping part overlapping at least a part of the other electrode part formed by another of the electrode layers adjacent to the one electrode layer in the stacking direction and a non-overlapping part not overlapping the other electrode part when viewed from the stacking direction.

In the multilayer coil component according to one aspect of the present invention, the one electrode part in the terminal electrode has the overlapping part overlapping at least a part of the other electrode part and the non-overlapping part not overlapping the other electrode part. As a result, in the multilayer coil component, a contact area with the element body can be ensured on the surface that faces the element body at the non-overlapping part of the one electrode part exposed on the side surface of the element body. Accordingly, in the multilayer coil component, the bonding strength between the terminal electrode and the element body can be ensured, and thus it is possible to suppress the terminal electrode peeling off the element body. As a result, the occurrence of a defect in the terminal electrode can be suppressed in the multilayer coil component.

In one embodiment, the other electrode part may have a first part extending along a facing direction of the pair of main surfaces and a second part extending along a facing direction of the pair of end surfaces when viewed from the stacking direction, and the non-overlapping part of the one electrode part may include a region corresponding to a corner portion formed by the first part and the second part when viewed from the stacking direction. In this configuration, the contact area with the element body can be more reliably ensured at the non-overlapping part. Accordingly, it is possible to suppress the terminal electrode peeling off the element body and the occurrence of a defect in the terminal electrode can be suppressed in the multilayer coil component.

In one embodiment, the non-overlapping part of the one electrode part may have a part curved in a convex shape in a direction away from the coil when viewed from the stacking direction. In this configuration, it is possible to reduce the stray capacitance that is generated in relation to the coil while ensuring a contact area with the element body at the non-overlapping part.

In one embodiment, the non-overlapping part of the one electrode part may have an uneven part when viewed from the stacking direction. In this configuration, it is possible to reduce the stray capacitance that is generated in relation to the coil while ensuring a contact area with the element body at the non-overlapping part.

In one embodiment, each of the pair of terminal electrodes and the coil may not overlap when viewed from the stacking direction. In this configuration, the stray capacitance that is generated between each of the pair of terminal electrodes and the coil can be reduced. As a result, it is possible to achieve an improvement in characteristics in the multilayer coil component.

In one embodiment, each of the pair of terminal electrodes and the coil may not overlap when viewed from a facing direction of the pair of end surfaces. In this configuration, the stray capacitance that is generated between each of the pair of terminal electrodes and the coil can be reduced. As a result, it is possible to achieve an improvement in characteristics in the multilayer coil component.

According to one aspect of the present invention, it is possible to suppress the occurrence of a defect in the terminal electrode.

DETAILED DESCRIPTION

Hereinafter, preferred embodiments of the present invention will be described in detail with reference to the accompanying drawings. It should be noted that the same or corresponding elements will be denoted by the same reference symbols without redundant description in the description of the drawings.

First Embodiment

Figure 1:
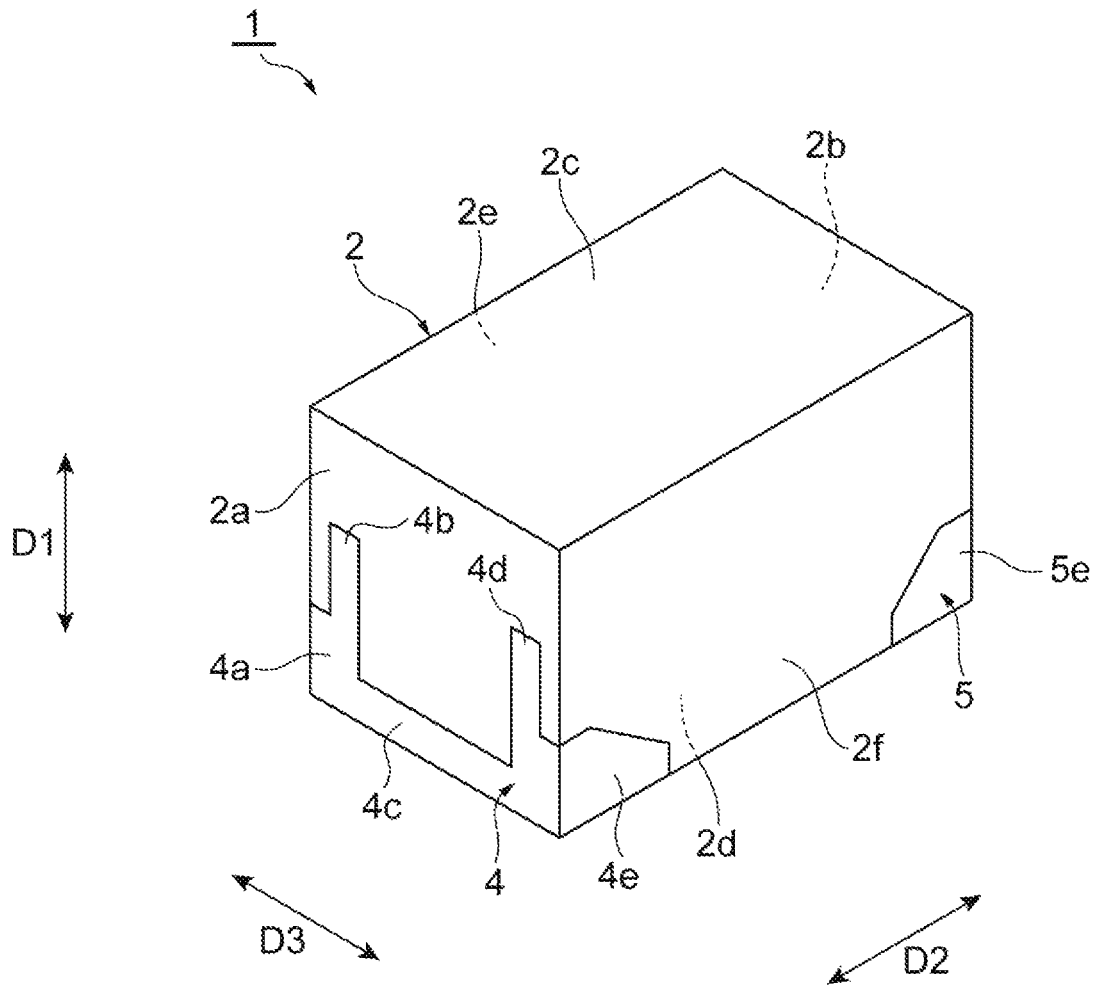
FIG. 1 is a perspective view illustrating a multilayer coil component according to a first embodiment.

As illustrated in FIG. 1, a multilayer coil component 1 includes an element body 2 having a rectangular parallelepiped shape and a pair of terminal electrodes 4 and 5. The pair of terminal electrodes 4 and 5 are respectively disposed in both end portions of the element body 2. The rectangular parallelepiped shape includes a rectangular parallelepiped shape in which a corner portion and a ridge line portion are chamfered and a rectangular parallelepiped shape in which a corner portion and a ridge line portion are rounded.

The element body 2 has a pair of end surfaces 2*a* and 2*b* facing each other, a pair of main surfaces 2*c* and 2*d* facing each other, and a pair of side surfaces 2*e* and 2*f* facing each other. The direction in which the pair of main surfaces 2*c* and 2*d* face each other, that is, a direction parallel to the end surfaces 2*a* and 2*b* is a first direction D1. The direction in which the pair of end surfaces 2*a* and 2*b* face each other, that is, a direction parallel to the main surfaces 2*c* and 2*d* is a second direction D2. The direction in which the pair of side surfaces 2*e* and 2*f* face each other is a third direction D3. In the present embodiment, the first direction D1 is the height direction of the element body 2. The second direction D2 is the longitudinal direction of the element body 2 and is orthogonal to the first direction D1. The third direction D3 is the width direction of the element body 2 and is orthogonal to the first direction D1 and the second direction D2.

The pair of end surfaces 2*a* and 2*b* extend in the first direction D1 so as to interconnect the pair of main surfaces 2*c* and 2*d*. The pair of end surfaces 2*a* and 2*b* also extend in the third direction D3, that is, the short side direction of the pair of main surfaces 2*c* and 2*d*. The pair of side surfaces 2*e* and 2*f* extend in the first direction D1 so as to interconnect the pair of main surfaces 2*c* and 2*d*. The pair of side surfaces 2*e* and 2*f* also extend in the second direction D2, that is, the long side direction of the pair of end surfaces 2*a* and 2*b*. The multilayer coil component 1 is, for example, solder-mounted onto an electronic device (such as a circuit board and an electronic component). In the multilayer coil component 1, the main surface 2*d* constitutes a mounting surface facing the electronic device.

Figure 2:
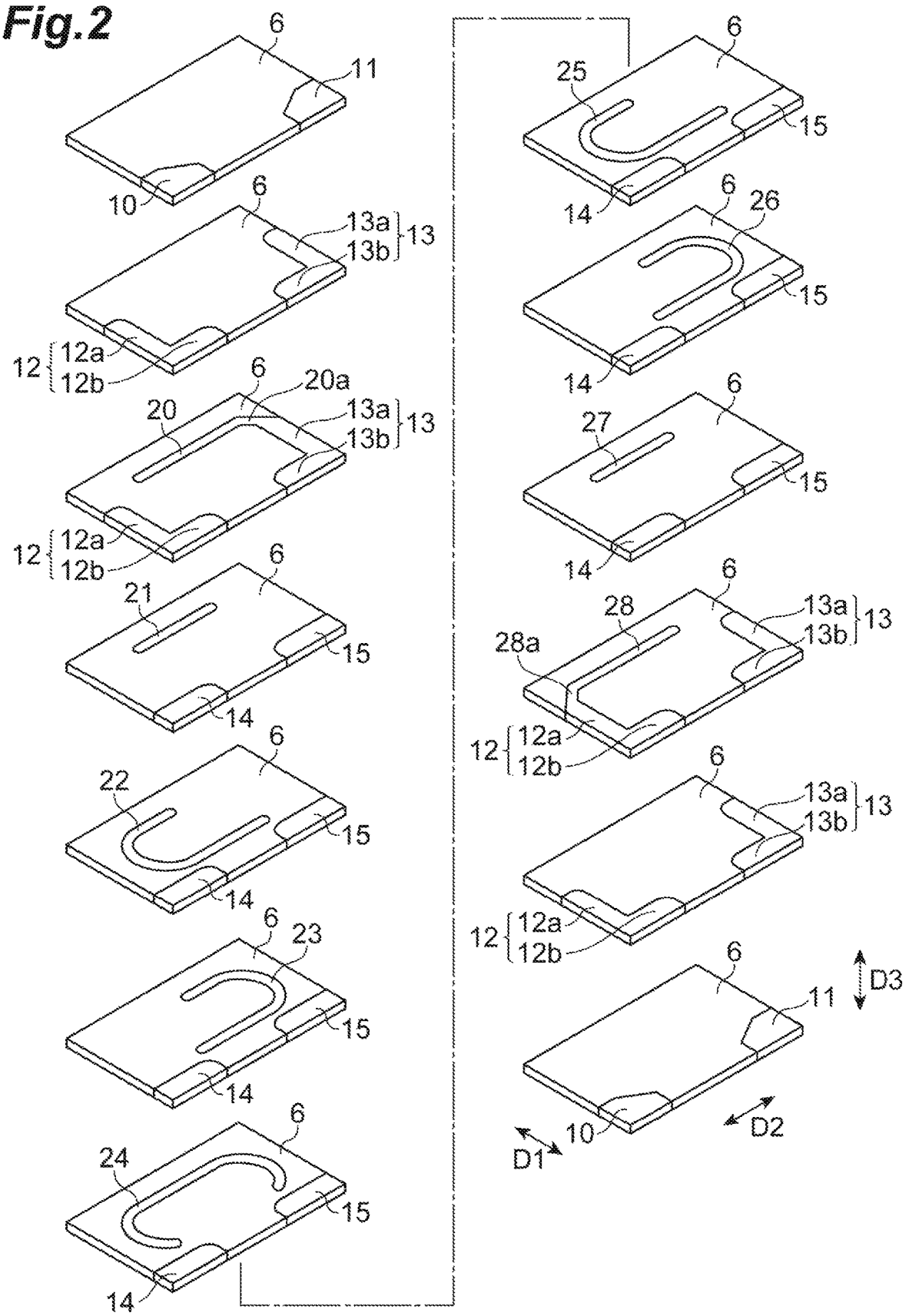
FIG. 2 is an exploded perspective view of the multilayer coil component illustrated in FIG. 1.

As illustrated in FIG. 2, the element body 2 is configured by a plurality of dielectric layers 6 being stacked in the third direction D3. The element body 2 has the plurality of stacked dielectric layers 6. In the element body 2, the stacking direction of the plurality of dielectric layers 6 coincides with the third direction D3. In the actual element body 2, each dielectric layer 6 is integrated to the extent that the boundaries between the dielectric layers 6 cannot be visually recognized. Each dielectric layer 6 is made of, for example, a magnetic material. Examples of the magnetic material include a Ni—Cu—Zn-based ferrite material, a Ni—Cu—Zn—Mg-based ferrite material, and a Ni—Cu-based ferrite material. The magnetic material that constitutes each dielectric layer 6 may include a Fe alloy. Each dielectric layer 6 may be made of a non-magnetic material. Examples of the non-magnetic material include a glass ceramic material and a dielectric material. In the present embodiment, each dielectric layer 6 is made of a sintered body of a green sheet containing a magnetic material.

Figure 3:
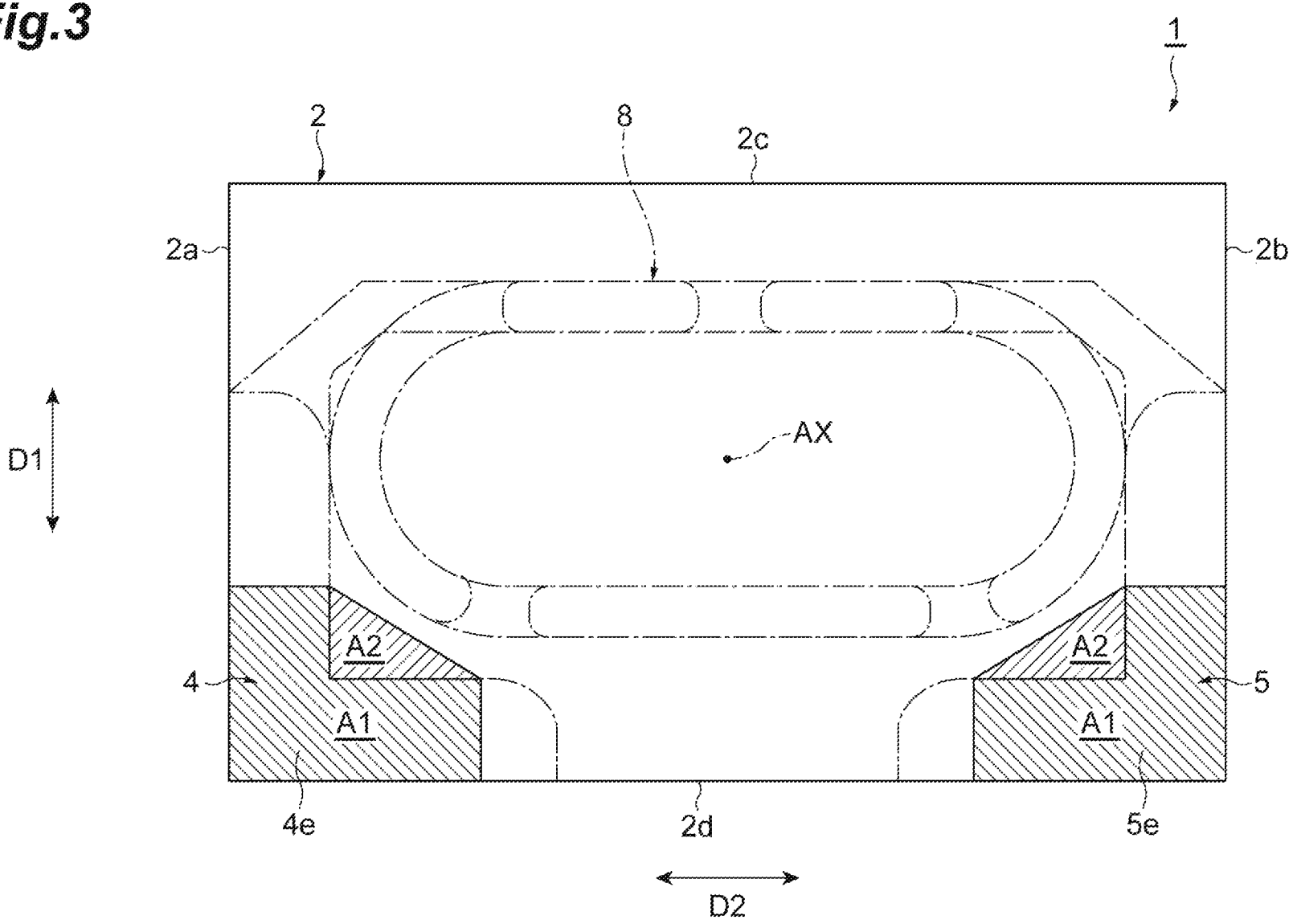
FIG. 3 is a side view illustrating the configuration of the multilayer coil component.

As illustrated in FIG. 3, the terminal electrode 4 is disposed on the end surface 2*a* side of the element body 2. The terminal electrode 5 is disposed on the end surface 2*b* side of the element body 2. The pair of terminal electrodes 4 and 5 are separated from each other in the second direction D2. Each of the terminal electrodes 4 and 5 is embedded in the element body 2. The terminal electrode 4 is disposed over the end surface 2*a* and the main surface 2*d*. The terminal electrode 5 is disposed over the end surface 2*b* and the main surface 2*d*. In the present embodiment, the surface of the terminal electrode 4 is substantially flush with each of the end surface 2*a* and the main surface 2*d*. The surface of the terminal electrode 5 is substantially flush with each of the end surface 2*b* and the main surface 2*d*.

Each of the terminal electrodes 4 and 5 contains a conductive material. The conductive material contains, for example, Ag or Pd. Each of the terminal electrodes 4 and 5 is configured as a sintered body of conductive paste containing conductive material powder. Examples of the conductive material powder include Ag powder and Pd powder. A plating layer may be formed on the surface of each of the terminal electrodes 4 and 5. The plating layer is formed by, for example, electroplating or electroless plating. The plating layer contains, for example, Ni, Sn, or Au.

The terminal electrode 4 is exposed on the end surface 2*a*, the main surface 2*d*, and the side surfaces 2*e* and 2*f*. The terminal electrode 4 has a plurality of electrode parts 4*a*, 4*b*, 4*c*, 4*d*, and 4*e*. In the present embodiment, the electrode parts 4*a*, 4*b*, 4*c*, 4*d*, and 4*e* are integrally formed. The electrode part (one electrode part) 4*a* is disposed in one end portion in the third direction D3 and is exposed on the end surface 2*a*, the main surface 2*d*, and the side surface 2*e*. The electrode part (the other electrode part) 4*b* is disposed adjacent to the electrode part 4*a* and is exposed on the end surface 2*a* and the main surface 2*d*. The electrode part 4*c* is disposed adjacent to the electrode part 4*b* and is exposed on the end surface 2*a* and the main surface 2*d*. The electrode part (the other electrode part) 4*d* is disposed adjacent to the electrode part 4*c* and is exposed on the end surface 2*a* and the main surface 2*d*. The electrode part (one electrode part) 4*e* is disposed in the other end portion in the third direction D3 and is exposed on the end surface 2*a*, the main surface 2*d*, and the side surface 2*f*.

Figure 4B:
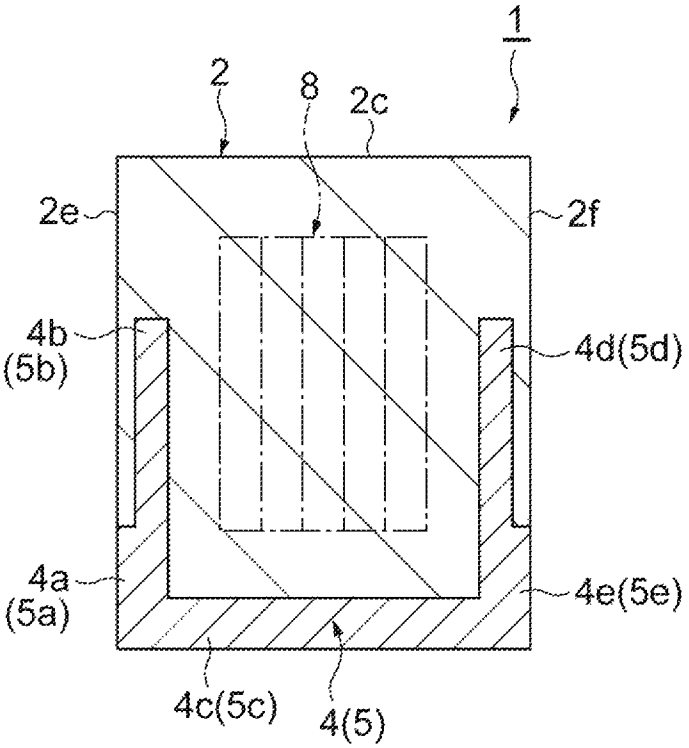
FIG. 4B is a diagram illustrating a cross-sectional configuration along a first direction.
Figure 4A:
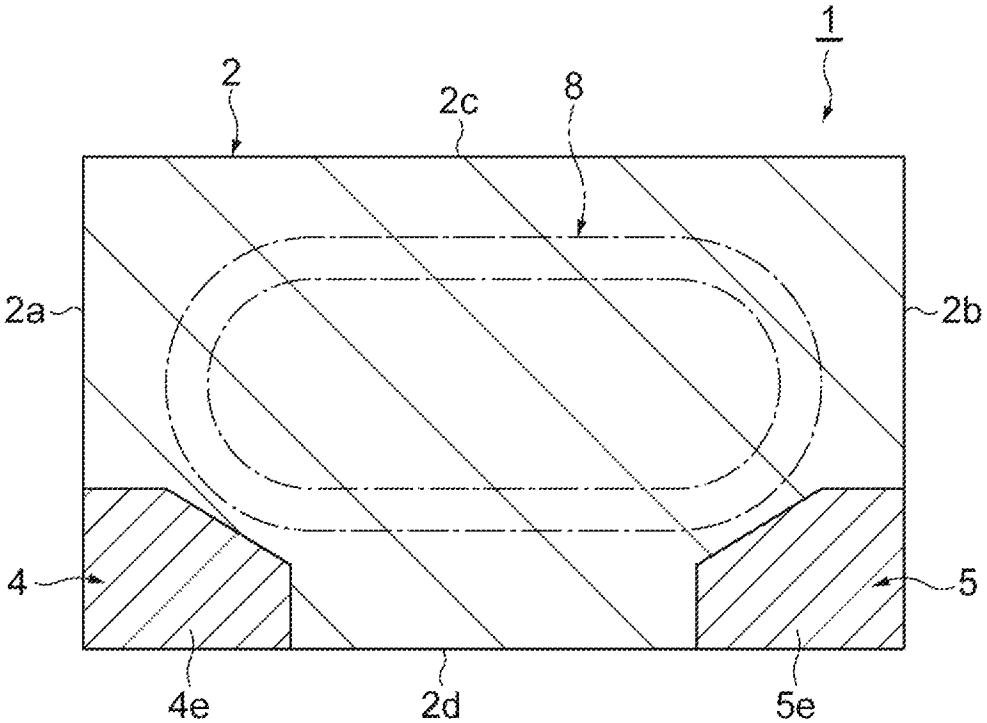
FIG. 4A is a diagram illustrating a cross-sectional configuration along a second direction.

As illustrated in FIGS. 3 and 4A, the electrode parts 4*a* and 4*e* have a polygonal shape when viewed from the third direction D3. The electrode parts 4*a* and 4*e* have a shape in which one corner portion of a rectangle is linearly cut out. Specifically, the electrode parts 4*a* and 4*e* are in contact with the element body 2 on three sides when viewed from the third direction D3. Of the three sides, a first side extends along the first direction D1, a second side extends along the second direction D2, and a third side connects the end portion of the first side on the main surface 2*c* side and the end portion of the second side on the end surface 2*b* side and is inclined toward the main surface 2*d* side.

As illustrated in FIG. 3, the electrode parts 4*b* and 4*d* have an L shape when viewed from the third direction D3. The electrode parts 4*b* and 4*d* have a first part extending along the first direction D1 and a second part extending along the second direction D2, and the first part and the second part are connected in the ridge line portion of the element body 2. The electrode part 4*c* has a rectangular parallelepiped shape. The electrode part 4*c* extends along the second direction D2 and the third direction D3.

The electrode part 4*e* (4*a*) has an overlapping part A1 overlapping the electrode part 4*d* (4*b*) and a non-overlapping part A2 not overlapping the electrode part 4*d* (4*b*) when viewed from the third direction D3. In other words, the electrode part 4*e* (4*a*) has a part overlapping the electrode part adjacent in the third direction D3 and a part not overlapping the electrode part adjacent in the third direction D3. At the electrode part 4*e* (4*a*), the non-overlapping part A2 not overlapping the electrode part 4*d* (4*b*) includes a region corresponding to the corner portion formed by the first part and the second part of the L-shaped electrode part 4*d* (4*b*) and has, for example, a triangular shape. At the non-overlapping part A2, one side surface in the third direction D3 is exposed and the other side surface is in contact with the element body 2.

As illustrated in FIG. 2, the terminal electrode 4 is configured by a plurality of electrode layers 10, a plurality of electrode layers 12, and a plurality of electrode layers 14 being stacked. In the present embodiment, the number of the electrode layers 10 is "2", the number of the electrode layers 12 is "4", and the number of the electrode layers 14 is "7". The electrode layers 10, 12, and 14 are provided in a defective portion formed in the corresponding dielectric layer 6. The electrode layers 10, 12, and 14 are formed by conductive paste positioned in a defective portion formed in a green sheet being fired. The green sheet and the conductive paste are fired at the same time. Accordingly, the electrode layers 10, 12, and 14 are obtained from the conductive paste when the dielectric layer 6 is obtained from the green sheet. In the actual terminal electrode 4, each of the electrode layers 10, 12, and 14 is integrated to the extent that the boundaries between the electrode layers 10, 12, and 14 cannot be visually recognized.

Each electrode layer 10 is disposed in the outermost portion of the terminal electrode 4 in the third direction D3. In other words, each electrode layer 10 constitutes the electrode parts 4*a* and 4*e*. Each electrode layer 12 has an L shape when viewed from the third direction D3. The electrode layer 12 constitutes the electrode parts 4*b* and 4*d*. The electrode layer 12 has a plurality of layer parts 12*a* and 12*b*. The layer part 12*a* extends along the first direction D1. The layer part 12*b* extends along the second direction D2. Each electrode layer 14 has a linear shape when viewed from the third direction D3. The electrode layer 14 extends along the second direction D2. The electrode layer 14 constitutes the electrode part 4*c*.

The terminal electrode 5 is exposed on the end surface 2*b*, the main surface 2*d*, and the side surfaces 2*e* and 2*f*. The terminal electrode 5 has a plurality of electrode parts 5*a*, 5*b*, 5*c*, 5*d*, and 5*e* (see FIG. 4B). In the present embodiment, the electrode parts 5*a*, 5*b*, 5*c*, 5*d*, and 5*e* are integrally formed. The electrode part (one electrode part) 5*a* is disposed in one end portion in the third direction D3 and is exposed on the end surface 2*b*, the main surface 2*d*, and the side surface 2*e*. The electrode part (the other electrode part) 5*b* is disposed adjacent to the electrode part 5*a* and is exposed on the end surface 2*b* and the main surface 2*d*. The electrode part 5*c* is disposed adjacent to the electrode part 5*b* and is exposed on the end surface 2*b* and the main surface 2*d*. The electrode part (the other electrode part) 5*d* is disposed adjacent to the electrode part 5*c* and is exposed on the end surface 2*b* and the main surface 2*d*. The electrode part (one electrode part) 5*e* is disposed in the other end portion in the third direction D3 and is exposed on the end surface 2*b*, the main surface 2*d*, and the side surface 2*f*.

The electrode parts 5*a* and 5*e* have a polygonal shape when viewed from the third direction D3. The electrode parts 5*a* and 5*e* have a shape in which one corner portion of a rectangle is linearly cut out. Specifically, the electrode parts 5*a* and 5*e* are in contact with the element body 2 on three sides when viewed from the third direction D3. Of the three sides, a first side extends along the first direction D1, a second side extends along the second direction D2, and a third side connects the end portion of the first side on the main surface 2*c* side and the end portion of the second side on the end surface 2*a* side and is inclined toward the main surface 2*d* side.

The electrode parts 5*b* and 5*d* have an L shape when viewed from the third direction D3. The electrode parts 5*b* and 5*d* have a first part extending along the first direction D1 and a second part extending along the second direction D2, and the first part and the second part are connected in the ridge line portion of the element body 2. The electrode part 5*c* has a rectangular parallelepiped shape. The electrode part 5*c* extends along the second direction D2 and the third direction D3.

As illustrated in FIG. 3, the electrode part 5*e* (5*a*) has the overlapping part A1 overlapping the electrode part 5*d* (5*b*) and the non-overlapping part A2 not overlapping the electrode part 5*d* (5*b*) when viewed from the third direction D3. In other words, the electrode part 5*e* (5*a*) has a part overlapping the electrode part adjacent in the third direction D3 and a part not overlapping the electrode part adjacent in the third direction D3. At the electrode part 5*e* (5*a*), the non-overlapping part A2 not overlapping the electrode part 5*d* (5*b*) includes a region corresponding to the corner portion formed by the first part and the second part of the L-shaped electrode part 5*d* (5*b*) and has, for example, a triangular shape. At the non-overlapping part A2, one side surface in the third direction D3 is exposed and the other side surface is in contact with the element body 2.

As illustrated in FIG. 2, the terminal electrode 5 is configured by a plurality of electrode layers 11, a plurality of electrode layers 13, and a plurality of electrode layers 15 being stacked. In the present embodiment, the number of the electrode layers 11 is "2", the number of the electrode layers 13 is "4", and the number of the electrode layers 15 is "7". The electrode layers 11, 13, and 15 are provided in a defective portion formed in the corresponding dielectric layer 6. The electrode layers 11, 13, and 15 are formed by conductive paste positioned in a defective portion formed in a green sheet being fired. The green sheet and the conductive paste are fired at the same time. Accordingly, the electrode layers 11, 13, and 15 are obtained from the conductive paste when the dielectric layer 6 is obtained from the green sheet. In the actual terminal electrode 5, each of the electrode layers 11, 13, and 15 is integrated to the extent that the boundaries between the electrode layers 11, 13, and 15 cannot be visually recognized.

Each electrode layer 11 is disposed in the outermost portion of the terminal electrode 5 in the third direction D3. In other words, each electrode layer 11 constitutes the electrode parts 5*a* and 5*e*. Each electrode layer 13 has an L shape when viewed from the third direction D3. The electrode layer 13 constitutes the electrode parts 5*b* and 5*d*. The electrode layer 13 has a plurality of layer parts 13*a* and 13*b*. The layer part 13*a* extends along the first direction D1. The layer part 13*b* extends along the second direction D2. Each electrode layer 15 has a linear shape when viewed from the third direction D3. The electrode layer 15 extends along the second direction D2. The electrode layer 15 constitutes the electrode part 5*c*.

As illustrated in FIG. 3, the multilayer coil component 1 includes a coil 8 disposed in the element body 2. A coil axis AX of the coil 8 extends along the third direction D3. The coil 8 has a substantially elliptical shape when viewed from the third direction D3.

As illustrated in FIG. 2, the coil 8 has a first coil conductor 22, a second coil conductor 23, a third coil conductor 24, a fourth coil conductor 25, and a fifth coil conductor 26. The first coil conductor 22, the second coil conductor 23, the third coil conductor 24, the fourth coil conductor 25, and the fifth coil conductor 26 are disposed along the third direction D3 in the order of the first coil conductor 22, the second coil conductor 23, the third coil conductor 24, the fourth coil conductor 25, and the fifth coil conductor 26. The first coil conductor 22, the second coil conductor 23, the third coil conductor 24, the fourth coil conductor 25, and the fifth coil conductor 26 substantially have a shape in which a part of a loop is interrupted and have one end and the other end. The first coil conductor 22, the second coil conductor 23, the third coil conductor 24, the fourth coil conductor 25, and the fifth coil conductor 26 are formed with a predetermined width.

The multilayer coil component 1 has a first connection conductor 20 and a second connection conductor 21 connecting the terminal electrode 5 and one end of the coil 8 and a third connection conductor 27 and a fourth connection conductor 28 connecting the terminal electrode 4 and the other end of the coil 8. The first connection conductor 20, the second connection conductor 21, the third connection conductor 27, and the fourth connection conductor 28 have a linear shape. The first connection conductor 20, the second connection conductor 21, the third connection conductor 27, and the fourth connection conductor 28 are formed with a predetermined width.

The first connection conductor 20 is positioned in the same layer as one electrode layer 12 and one electrode layer 13. The first connection conductor 20 is connected to the electrode layer 13 via a connecting conductor 20*a*. The connecting conductor 20*a* is positioned in the same layer as the first connection conductor 20. One end of the first connection conductor 20 is connected to the connecting conductor 20*a*. The connecting conductor 20*a* is connected to the layer part 13*a*. The connecting conductor 20*a* connects the first connection conductor 20 and the electrode layer 13. The connecting conductor 20*a* may be connected to the layer part 13*b*. The first connection conductor 20 is separated from the electrode layer 12 positioned in the same layer. In the present embodiment, the first connection conductor 20, the connecting conductor 20*a*, and the electrode layer 13 are integrally formed.

The second connection conductor 21 is positioned in the same layer as one electrode layer 14 and one electrode layer 15. The second connection conductor 21 is separated from the electrode layers 14 and 15 positioned in the same layer. The first connection conductor 20 and the second connection conductor 21 are adjacent to each other in the third direction D3. The first connection conductor 20 and the second connection conductor 21 overlap each other when viewed from the third direction D3.

The first coil conductor 22 is positioned in the same layer as one electrode layer 14 and one electrode layer 15. The first coil conductor 22 is separated from the electrode layers 14 and 15 positioned in the same layer. The second connection conductor 21 and the first coil conductor 22 are adjacent to each other in the third direction D3. A part of the second connection conductor 21 and a part of the first coil conductor 22 overlap each other when viewed from the third direction D3.

The second coil conductor 23 is positioned in the same layer as one electrode layer 14 and one electrode layer 15. The second coil conductor 23 is separated from the electrode layers 14 and 15 positioned in the same layer. The first coil conductor 22 and the second coil conductor 23 are adjacent to each other in the third direction D3. A part of the first coil conductor 22 and a part of the second coil conductor 23 overlap each other when viewed from the third direction D3.

The third coil conductor 24 is positioned in the same layer as one electrode layer 14 and one electrode layer 15. The third coil conductor 24 is separated from the electrode layers 14 and 15 positioned in the same layer. The second coil conductor 23 and the third coil conductor 24 are adjacent to each other in the third direction D3. A part of the second coil conductor 23 and a part of the third coil conductor 24 overlap each other when viewed from the third direction D3.

The fourth coil conductor 25 is positioned in the same layer as one electrode layer 14 and one electrode layer 15. The fourth coil conductor 25 is separated from the electrode layers 14 and 15 positioned in the same layer. The third coil conductor 24 and the fourth coil conductor 25 are adjacent to each other in the third direction D3. A part of the third coil conductor 24 and a part of the fourth coil conductor 25 overlap each other when viewed from the third direction D3.

The fifth coil conductor 26 is positioned in the same layer as one electrode layer 14 and one electrode layer 15. The fifth coil conductor 26 is separated from the electrode layers 14 and 15 positioned in the same layer. The fourth coil conductor 25 and the fifth coil conductor 26 are adjacent to each other in the third direction D3. A part of the fourth coil conductor 25 and a part of the fifth coil conductor 26 overlap each other when viewed from the third direction D3.

The third connection conductor 27 is positioned in the same layer as one electrode layer 14 and one electrode layer 15. The third connection conductor 27 is separated from the electrode layers 14 and 15 positioned in the same layer. The fifth coil conductor 26 and the third connection conductor 27 are adjacent to each other in the third direction D3. A part of the fifth coil conductor 26 and a part of the third connection conductor 27 overlap each other when viewed from the third direction D3.

The fourth connection conductor 28 is positioned in the same layer as one electrode layer 12 and one electrode layer 13. The fourth connection conductor 28 is connected to the electrode layer 12 via a connecting conductor 28*a*. The connecting conductor 28*a* is positioned in the same layer as the fourth connection conductor 28. One end of the fourth connection conductor 28 is connected to the connecting conductor 28*a*. The connecting conductor 28*a* is connected to the layer part 12*a*. The connecting conductor 28*a* connects the fourth connection conductor 28 and the electrode layer 12. The connecting conductor 28*a* may be connected to the layer part 12*b*. The fourth connection conductor 28 is separated from the electrode layer 13 positioned in the same layer. In the present embodiment, the fourth connection conductor 28, the connecting conductor 28*a*, and the electrode layer 12 are integrally formed.

The first connection conductor 20, the second connection conductor 21, the first coil conductor 22, the second coil conductor 23, the third coil conductor 24, the fourth coil conductor 25, the fifth coil conductor 26, the third connection conductor 27, and the fourth connection conductor 28 are electrically connected. The first coil conductor 22, the second coil conductor 23, the third coil conductor 24, the fourth coil conductor 25, and the fifth coil conductor 26 constitute the coil 8. The coil 8 is electrically connected to the terminal electrode 5 through the first connection conductor 20 and the second connection conductor 21. The coil 8 is electrically connected to the terminal electrode 4 through the third connection conductor 27 and the fourth connection conductor 28.

The first coil conductor 22, the second coil conductor 23, the third coil conductor 24, the fourth coil conductor 25, the fifth coil conductor 26, the first connection conductor 20, the second connection conductor 21, the third connection conductor 27, the fourth connection conductor 28, and the connecting conductors 20*a* and 28*a* contain a conductive material. The conductive material contains Ag or Pd. The first coil conductor 22, the second coil conductor 23, the third coil conductor 24, the fourth coil conductor 25, the fifth coil conductor 26, the first connection conductor 20, the second connection conductor 21, the third connection conductor 27, the fourth connection conductor 28, and the connecting conductors 20*a* and 28*a* are configured as a sintered body of conductive paste containing conductive material powder. Examples of the conductive material powder include Ag powder and Pd powder.

In the present embodiment, the first coil conductor 22, the second coil conductor 23, the third coil conductor 24, the fourth coil conductor 25, the fifth coil conductor 26, the first connection conductor 20, the second connection conductor 21, the third connection conductor 27, the fourth connection conductor 28, and the connecting conductors 20*a* and 28*a* contain the same conductive material as each of the terminal electrodes 4 and 5. The first coil conductor 22, the second coil conductor 23, the third coil conductor 24, the fourth coil conductor 25, the fifth coil conductor 26, the first connection conductor 20, the second connection conductor 21, the third connection conductor 27, the fourth connection conductor 28, and the connecting conductors 20*a* and 28*a* may contain a conductive material different from the conductive material of each of the terminal electrodes 4 and 5.

The first coil conductor 22, the second coil conductor 23, the third coil conductor 24, the fourth coil conductor 25, the fifth coil conductor 26, the first connection conductor 20, the second connection conductor 21, the third connection conductor 27, the fourth connection conductor 28, and the connecting conductors 20*a* and 28*a* are provided in a defective portion formed in the corresponding dielectric layer 6. The first coil conductor 22, the second coil conductor 23, the third coil conductor 24, the fourth coil conductor 25, the fifth coil conductor 26, the first connection conductor 20, the second connection conductor 21, the third connection conductor 27, the fourth connection conductor 28, and the connecting conductors 20*a* and 28*a* are formed by conductive paste positioned in a defective portion formed in a green sheet being fired. The green sheet and the conductive paste are fired at the same time as described above. Accordingly, the first coil conductor 22, the second coil conductor 23, the third coil conductor 24, the fourth coil conductor 25, the fifth coil conductor 26, the first connection conductor 20, the second connection conductor 21, the third connection conductor 27, the fourth connection conductor 28, and the connecting conductors 20*a* and 28*a* are obtained from the conductive paste when the dielectric layer 6 is obtained from the green sheet.

The defective portion formed in the green sheet is formed by, for example, the following process. First, a green sheet is formed by element body paste containing a constituent material of the dielectric layer 6 and a photosensitive material being applied onto a base material. The base material is, for example, a PET film. The photosensitive material contained in the element body paste may be either a negative-type photosensitive material or a positive-type photosensitive material, and a known material can be used as the photosensitive material. Next, the green sheet is exposed and developed by the photolithography method by means of a mask corresponding to the defective portion and the defective portion is formed in the green sheet on the base material. The green sheet where the defective portion is formed is an element body pattern.

The electrode layers 10, 11, 12, 13, 14, and 15, the first coil conductor 22, the second coil conductor 23, the third coil conductor 24, the fourth coil conductor 25, the fifth coil conductor 26, the first connection conductor 20, the second connection conductor 21, the third connection conductor 27, the fourth connection conductor 28, and the connecting conductors 20*a* and 28*a* are formed by, for example, the following process.

First, a conductor material layer is formed by conductive paste containing a photosensitive material being applied onto a base material. The photosensitive material contained in the conductive paste may be either a negative-type photosensitive material or a positive-type photosensitive material, and a known material can be used as the photosensitive material. Next, the conductor material layer is exposed and developed by the photolithography method by means of a mask corresponding to the defective portion and a conductor pattern corresponding to the shape of the defective portion is formed on the base material.

The multilayer coil component 1 is obtained by, for example, the following process that follows the process described above. A sheet in which the element body pattern and the conductor pattern are in the same layer is prepared by the conductor pattern being combined with the defective portion of the element body pattern. A stacked body is obtained by a predetermined number of the prepared sheets being stacked, heat treatment is performed on the stacked body, and then a plurality of green chips are obtained from the stacked body. In this process, a green stacked body is cut into chips by, for example, a cutting machine. As a result, a plurality of green chips having a predetermined size can be obtained. Next, the green chip is fired. The multilayer coil component 1 is obtained as a result of this firing. In the multilayer coil component 1, the terminal electrodes 4 and 5 and the coil 8 are integrally formed.

As illustrated in FIG. 2, the terminal electrode 4 and the coil 8 do not overlap when viewed from the third direction D3. Likewise, the terminal electrode 5 and the coil 8 do not overlap when viewed from the third direction D3. In addition, as illustrated in FIG. 4B, the terminal electrode 4 and the coil 8 do not overlap when viewed from the second direction D2. Likewise, the terminal electrode 5 and the coil 8 do not overlap when viewed from the second direction D2.

In the process for manufacturing the multilayer coil component 1, the stacked body is obtained by a predetermined number of the sheets being stacked on the base material and the stacked body is cut as described above. The stacked body is peeled off the base material when the stacked body is cut. In a case where the adhesive force between the electrode layers 10 and 11 and the dielectric layer 6 is small at this time, the electrode layers 10 and 11 disposed on the base material may adhere to the base material and be damaged or the electrode layers 10 and 11 may partially peel off the stacked body. In addition, during the cutting by the cutting machine, the surface that was in contact with the base material is a cutting machine blade entry surface. The electrode layers 10 and 11 may peel off due to a cutting machine blade at this time, and the electrode layers 10 and 11 are capable of easily peeling off when the blade has entered especially in a case where the electrode layers 10 and 11 have already peeled off in part. The terminal electrodes 4 and 5 may peel off the element body 2 when barrel polishing is performed with the electrode layers 10 and 11 having peeled off.

Regarding the above problem, in the multilayer coil component 1 according to the present embodiment, the electrode parts 4*a* and 4*e* in the terminal electrode 4 have the overlapping part A1 overlapping at least a part of the electrode parts 4*b* and 4*d* and the non-overlapping part A2 not overlapping the electrode parts 4*b* and 4*d*. As a result, in the multilayer coil component 1, a contact area with the element body 2 can be ensured on the surface that faces the element body 2 at the non-overlapping part A2 of the electrode parts 4*a* and 4*e* exposed on the side surfaces 2*e* and 2*f* of the element body 2. The adhesive force between the electrode parts 4*a*, 4*b*, 4*c*, 4*d*, and 4*e* and the element body 2 is larger than the adhesive force between the electrode parts 4*a*, 4*b*, 4*c*, 4*d*, and 4*e*. The terminal electrode 5 has a similar configuration. Accordingly, in the multilayer coil component 1, it is possible to suppress the terminal electrodes 4 and 5 peeling off the element body 2 by ensuring the bonding strength between the terminal electrodes 4 and 5 and the element body 2. As a result, the occurrence of a defect in the terminal electrodes 4 and 5 can be suppressed in the multilayer coil component 1.

In the multilayer coil component 1 according to the present embodiment, the electrode parts 4*b* and 4*d* have an L shape when viewed from the third direction D3 and have the first part extending along the first direction D1 and the second part extending along the second direction D2. The non-overlapping part A2 of the electrode parts 4*a* and 4*e* includes the region corresponding to the corner portion formed by the first part and the second part. In this configuration, the contact area with the element body 2 can be more reliably ensured at the non-overlapping part A2. Accordingly, it is possible to suppress the terminal electrodes 4 and 5 peeling off the element body 2 and the occurrence of a defect in the terminal electrodes 4 and 5 can be suppressed in the multilayer coil component 1.

In the multilayer coil component 1 according to the present embodiment, each of the pair of terminal electrodes 4 and 5 and the coil 8 do not overlap when viewed from the third direction D3. In this configuration, the stray capacitance that is generated between each of the terminal electrodes 4 and 5 and the coil 8 can be reduced. As a result, it is possible to achieve an improvement in characteristics in the multilayer coil component 1.

In the multilayer coil component 1 according to the present embodiment, each of the pair of terminal electrodes 4 and 5 and the coil 8 do not overlap when viewed from the second direction D2. In this configuration, the stray capacitance that is generated between each of the terminal electrodes 4 and 5 and the coil 8 can be reduced. As a result, it is possible to achieve an improvement in characteristics in the multilayer coil component 1.

Second Embodiment

Figure 5:
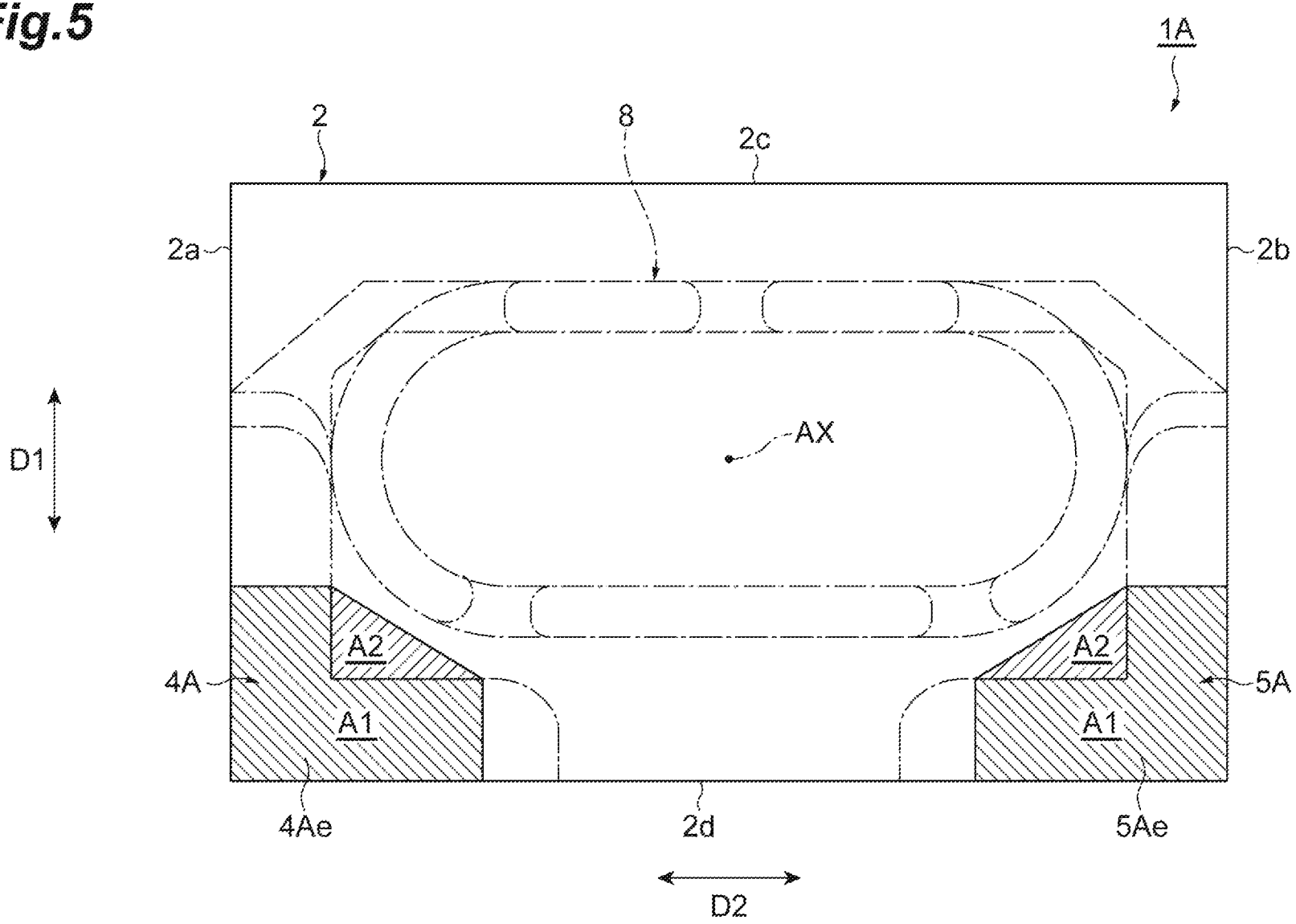
FIG. 5 is a side view illustrating the configuration of a multilayer coil component according to a second embodiment.
Figure 7B:
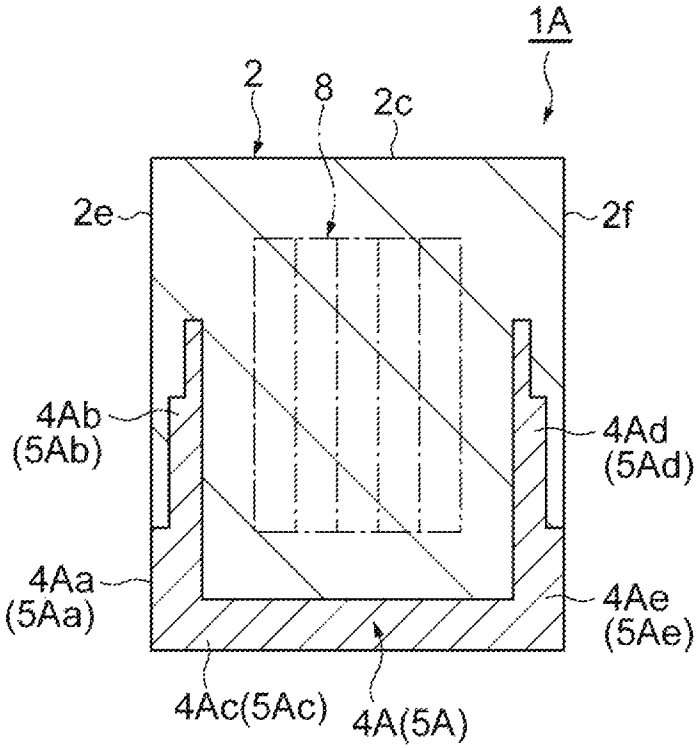
FIG. 7B is a diagram illustrating a cross-sectional configuration along the first direction.
Figure 7A:
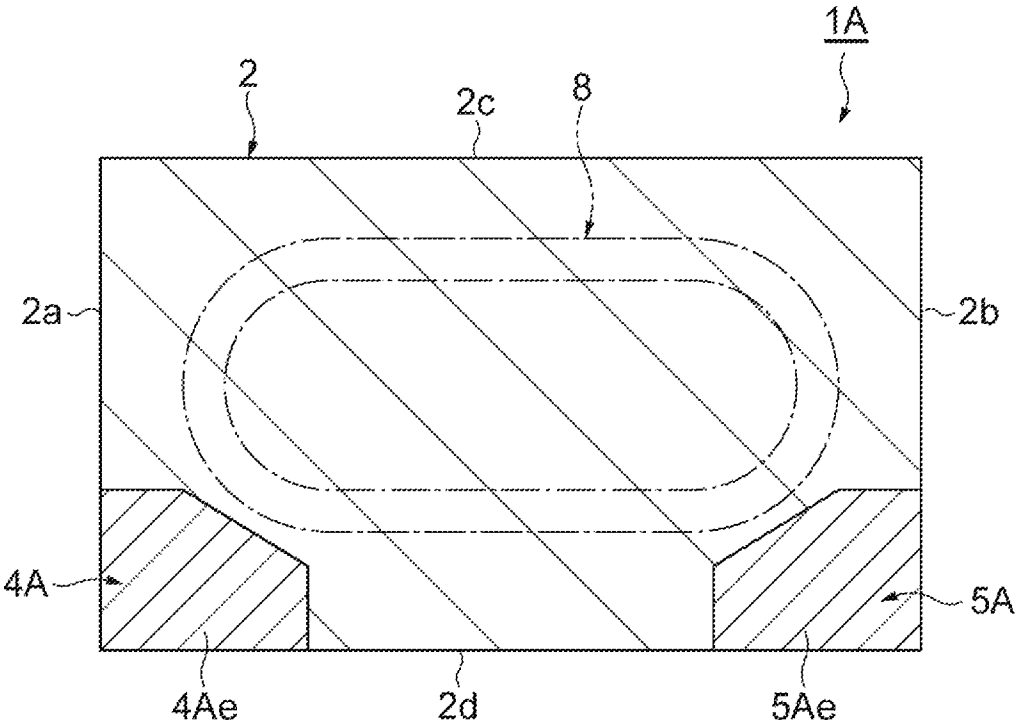
FIG. 7A is a diagram illustrating a cross-sectional configuration along the second direction.

Next, a second embodiment will be described. As illustrated in FIGS. 5, 7A, and 7B, a multilayer coil component 1A includes the element body 2 and a pair of terminal electrodes 4A and 5A. The multilayer coil component 1A is different in configuration from the multilayer coil component 1 in terms of the terminal electrodes 4A and 5A.

The terminal electrode 4A is exposed on the end surface 2*a*, the main surface 2*d*, and the side surfaces 2*e* and 2*f*. The terminal electrode 4A has a plurality of electrode parts 4Aa, 4Ab, 4Ac, 4Ad, and 4Ae. The electrode parts 4Aa, 4Ac, and 4Ae have the same configuration as the electrode parts 4*a*, 4*c*, and 4*e* of the multilayer coil component 1.

The electrode parts 4Ab and 4Ad have an L shape when viewed from the third direction D3. The electrode parts 4Ab and 4Ad have a first part extending along the first direction D1 and a second part extending along the second direction D2, and the first part and the second part are connected in the ridge line portion of the element body 2. As illustrated in FIG. 7B, a part of the electrode part 4Ab on the side surface 2*e* side is lower in the first direction D1 than on the side surface 2*f* side. A part of the electrode part 4Ad on the side surface 2*f* side is lower in the first direction D1 than on the side surface 2*e* side.

The electrode part 4Ae (4Aa) has the overlapping part A1 overlapping the electrode part 4Ad (4Ab) and the non-overlapping part A2 not overlapping the electrode part 4Ad (4Ab) when viewed from the third direction D3. In other words, the electrode part 4Ae (4Aa) has a part overlapping the electrode part adjacent in the third direction D3 and a part not overlapping the electrode part adjacent in the third direction D3. At the electrode part 4Ae (4Aa), the non-overlapping part A2 not overlapping the electrode part 4Ad (4Ab) includes a region corresponding to the corner portion formed by the first part and the second part of the L-shaped electrode part 4Ad (4Ab) and has, for example, a triangular shape. At the non-overlapping part A2, one side surface in the third direction D3 is exposed and the other side surface is in contact with the element body 2.

Figure 6:
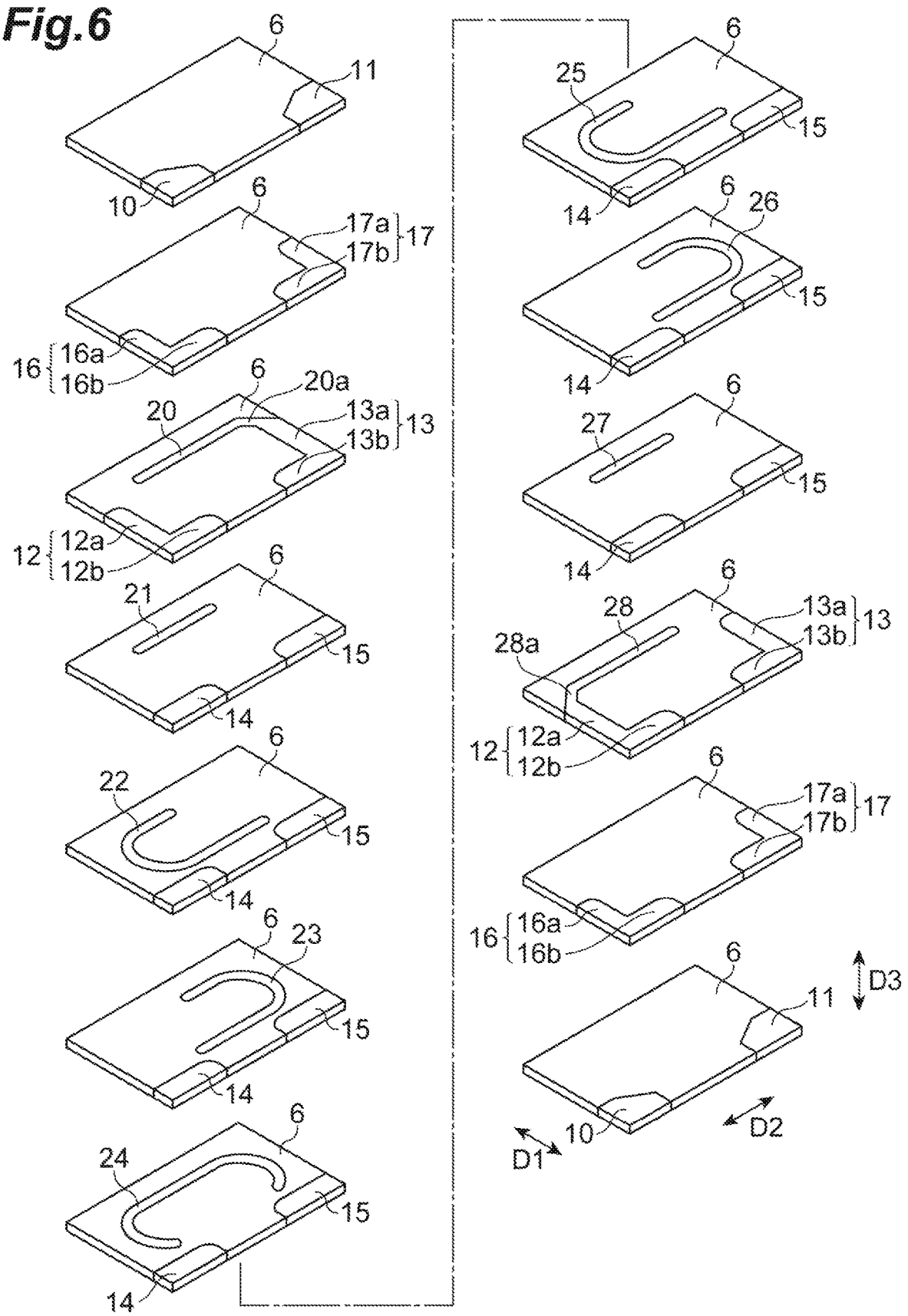
FIG. 6 is an exploded perspective view of the multilayer coil component illustrated in FIG. 5.

As illustrated in FIG. 6, the terminal electrode 4A is configured by the plurality of electrode layers 10, the plurality of electrode layers 12, the plurality of electrode layers 14, and a plurality of electrode layers 16 being stacked. In the present embodiment, the number of the electrode layers 10 is "2", the number of the electrode layers 12 is "2", the number of the electrode layers 14 is "7", and the number of the electrode layers 16 is "2". The electrode layer 16 constitutes the electrode parts 4Ab and 4Ad. The electrode layer 16 is lower in height than the electrode layer 12 in the first direction. As a result, the electrode parts 4Ab and 4Ad constituted by the electrode layer 12 and the electrode layer 16 have stepped end portions on the main surface 2*c* side.

As illustrated in FIGS. 5, 7A, and 7B, the terminal electrode 5A is exposed on the end surface 2*b*, the main surface 2*d*, and the side surfaces 2*e* and 2*f*. The terminal electrode 5A has a plurality of electrode parts 5Aa, 5Ab, 5Ac, 5Ad, and 5Ae. The electrode parts 5Aa, 5Ac, and 5Ae have the same configuration as the electrode parts 5*a*, 5*c*, and 5*e* of the multilayer coil component 1.

The electrode parts 5Ab and 5Ad have an L shape when viewed from the third direction D3. The electrode parts 5Ab and 5Ad have a first part extending along the first direction D1 and a second part extending along the second direction D2, and the first part and the second part are connected in the ridge line portion of the element body 2. As illustrated in FIG. 7B, a part of the electrode part 5Ab on the side surface 2*e* side is lower in the first direction D1 than on the side surface 2*f* side. A part of the electrode part 5Ad on the side surface 2*f* side is lower in the first direction D1 than on the side surface 2*e* side.

The electrode part 5Ae (5Aa) has the overlapping part A1 overlapping the electrode part 5Ad (5Ab) and the non-overlapping part A2 not overlapping the electrode part 5Ad (5Ab) when viewed from the third direction D3. In other words, the electrode part 5Ae (5Aa) has a part overlapping the electrode part adjacent in the third direction D3 and a part not overlapping the electrode part adjacent in the third direction D3. At the electrode part 5Ae (5Aa), the non-overlapping part A2 not overlapping the electrode part 5Ad (5Ab) includes a region corresponding to the corner portion formed by the first part and the second part of the L-shaped electrode part 5Ad (5Ab) and has, for example, a triangular shape. At the non-overlapping part A2, one side surface in the third direction D3 is exposed and the other side surface is in contact with the element body 2.

As illustrated in FIG. 6, the terminal electrode 5A is configured by the plurality of electrode layers 11, the plurality of electrode layers 13, the plurality of electrode layers 15, and a plurality of electrode layers 17 being stacked. In the present embodiment, the number of the electrode layers 11 is "2", the number of the electrode layers 13 is "2", the number of the electrode layers 15 is "7", and the number of the electrode layers 17 is "2". The electrode layer 17 constitutes the electrode parts 5Ab and 5Ad. The electrode layer 17 is lower in height than the electrode layer 13 in the first direction. As a result, the electrode parts 5Ab and 5Ad constituted by the electrode layer 13 and the electrode layer 17 have stepped end portions on the main surface 2*c* side.

As described above, the multilayer coil component 1A according to the present embodiment is similar in action and effect to the multilayer coil component 1.

Third Embodiment

Figure 8:
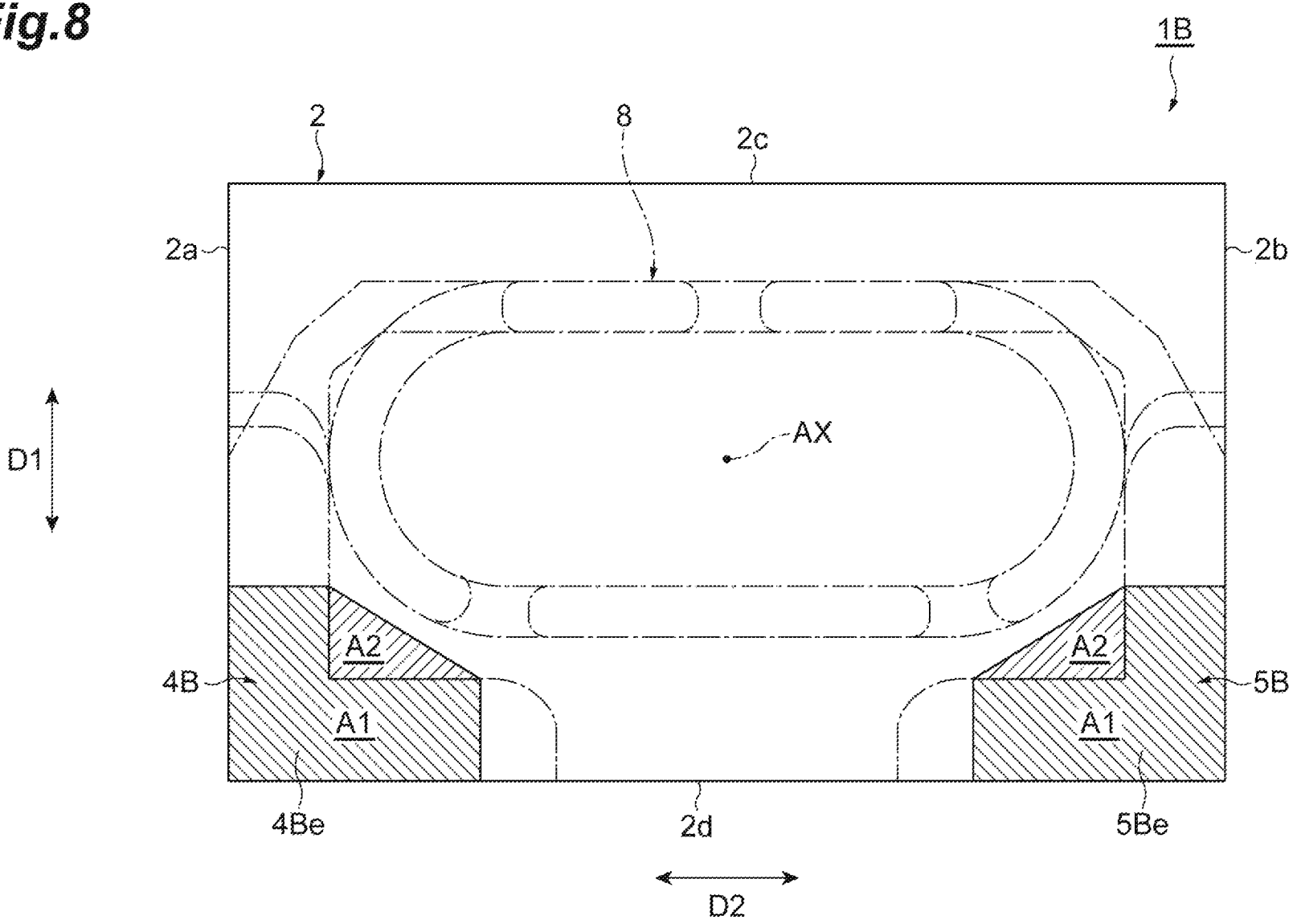
FIG. 8 is a side view illustrating the configuration of a multilayer coil component according to a third embodiment.
Figure 10B:
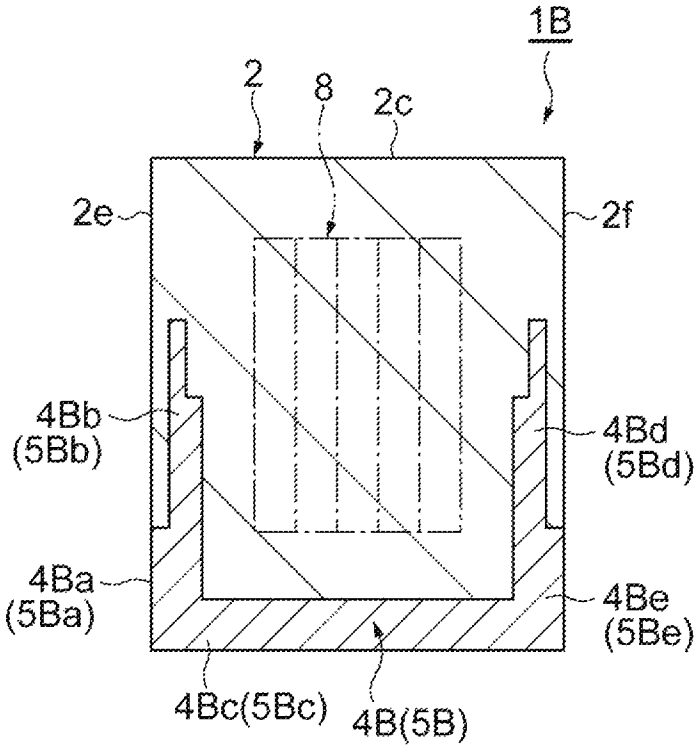
FIG. 10B is a diagram illustrating a cross-sectional configuration along the first direction.
Figure 10A:
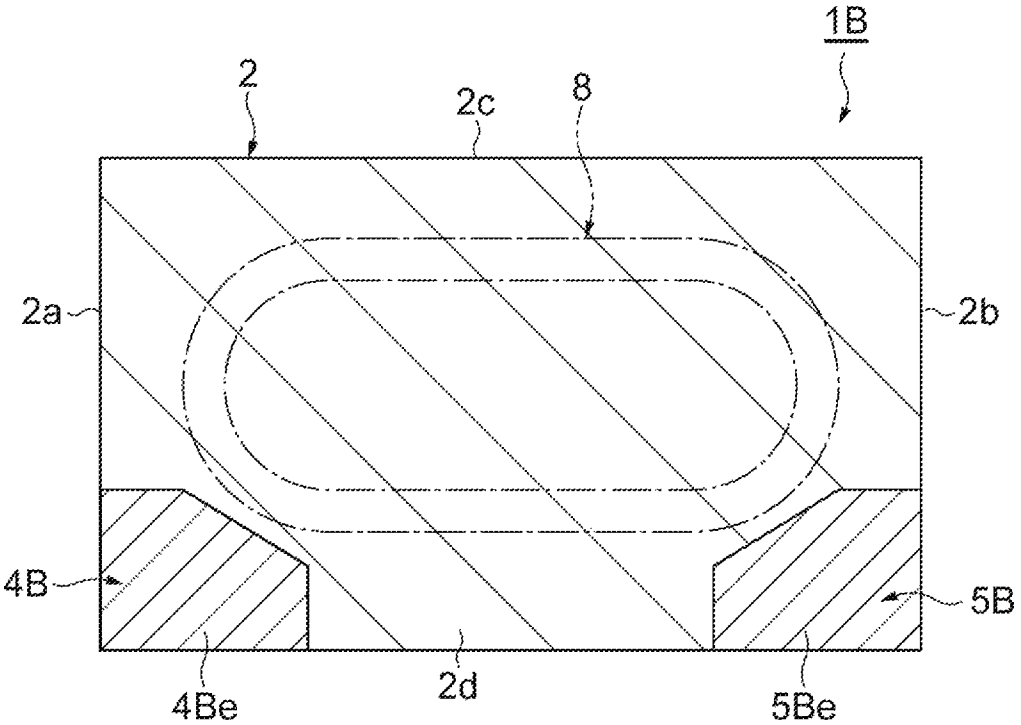
FIG. 10A is a diagram illustrating a cross-sectional configuration along the second direction.

Next, a third embodiment will be described. As illustrated in FIGS. 8, 10A, and 10B, a multilayer coil component 1B includes the element body 2 and a pair of terminal electrodes 4B and 5B. The multilayer coil component 1B is different in configuration from the multilayer coil component 1 in terms of the terminal electrodes 4B and 5B.

The terminal electrode 4B is exposed on the end surface 2*a*, the main surface 2*d*, and the side surfaces 2*e* and 2*f*. The terminal electrode 4B has a plurality of electrode parts 4Ba, 4Bb, 4Bc, 4Bd, and 4Be. The electrode parts 4Ba, 4Bc, and 4Be have the same configuration as the electrode parts 4*a*, 4*c*, and 4*e* of the multilayer coil component 1.

The electrode parts 4Bb and 4Bd have an L shape when viewed from the third direction D3. The electrode parts 4Bb and 4Bd have a first part extending along the first direction D1 and a second part extending along the second direction D2, and the first part and the second part are connected in the ridge line portion of the element body 2. As illustrated in FIG. 10B, a part of the electrode part 4Bb on the side surface 2*f* side is lower in the first direction D1 than on the side surface 2*e* side. A part of the electrode part 4Bd on the side surface 2*e* side is lower in the first direction D1 than on the side surface 2*f* side.

The electrode part 4Be (4Ba) has the overlapping part A1 overlapping the electrode part 4Bd (4Bb) and the non-overlapping part A2 not overlapping the electrode part 4Bd (4Bb) when viewed from the third direction D3. In other words, the electrode part 4Be (4Ba) has a part overlapping the electrode part adjacent in the third direction D3 and a part not overlapping the electrode part adjacent in the third direction D3. At the electrode part 4Be (4Ba), the non-overlapping part A2 not overlapping the electrode part 4Bd (4Bb) includes a region corresponding to the corner portion formed by the first part and the second part of the L-shaped electrode part 4Bd (4Bb) and has, for example, a triangular shape. At the non-overlapping part A2, one side surface in the third direction D3 is exposed and the other side surface is in contact with the element body 2.

Figure 9:
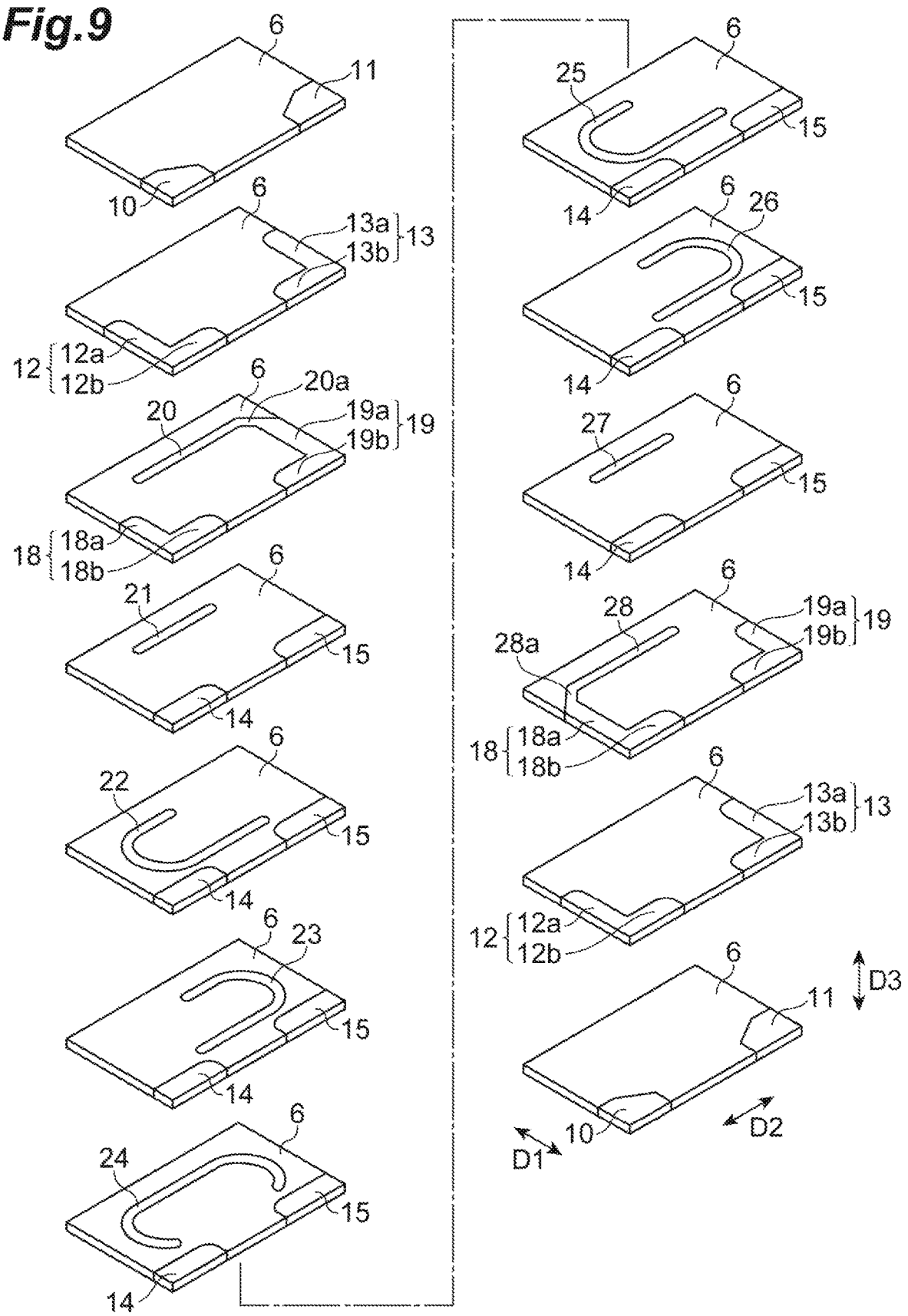
FIG. 9 is an exploded perspective view of the multilayer coil component illustrated in FIG. 8.

As illustrated in FIG. 9, the terminal electrode 4B is configured by the plurality of electrode layers 10, the plurality of electrode layers 12, the plurality of electrode layers 14, and a plurality of electrode layers 18 being stacked. In the present embodiment, the number of the electrode layers 10 is "2", the number of the electrode layers 12 is "2", the number of the electrode layers 14 is "7", and the number of the electrode layers 18 is "2". The electrode layer 18 constitutes the electrode parts 4Bb and 4Bd. The electrode layer 18 is lower in height than the electrode layer 12 in the first direction. As a result, the electrode parts 4Bb and 4Bd constituted by the electrode layer 12 and the electrode layer 18 have stepped end portions on the main surface 2*c* side.

As illustrated in FIGS. 8, 10A, and 10B, the terminal electrode 5B is exposed on the end surface 2*b*, the main surface 2*d*, and the side surfaces 2*e* and 2*f*. The terminal electrode 5B has a plurality of electrode parts 5Ba, 5Bb, 5Bc, 5Bd, and 5Be. The electrode parts 5Ba, 5Bc, and 5Be have the same configuration as the electrode parts 5*a*, 5*c*, and 5*e* of the multilayer coil component 1.

The electrode parts 5Bb and 5Bd have an L shape when viewed from the third direction D3. The electrode parts 5Bb and 5Bd have a first part extending along the first direction D1 and a second part extending along the second direction D2, and the first part and the second part are connected in the ridge line portion of the element body 2. As illustrated in FIG. 10B, a part of the electrode part 5Bb on the side surface 2*f* side is lower in the first direction D1 than on the side surface 2*e* side. A part of the electrode part 5Bd on the side surface 2*e* side is lower in the first direction D1 than on the side surface 2*f* side.

The electrode part 5Be (5Ba) has the overlapping part A1 overlapping the electrode part 5Bd (5Bb) and the non-overlapping part A2 not overlapping the electrode part 5Bd (5Bb) when viewed from the third direction D3. In other words, the electrode part 5Be (5Ba) has a part overlapping the electrode part adjacent in the third direction D3 and a part not overlapping the electrode part adjacent in the third direction D3. At the electrode part 5Be (5Ba), the non-overlapping part A2 not overlapping the electrode part 5Bd (5Bb) includes a region corresponding to the corner portion formed by the first part and the second part of the L-shaped electrode part 5Bd (5Bb) and has, for example, a triangular shape. At the non-overlapping part A2, one side surface in the third direction D3 is exposed and the other side surface is in contact with the element body 2.

As illustrated in FIG. 9, the terminal electrode 5B is configured by the plurality of electrode layers 11, the plurality of electrode layers 13, the plurality of electrode layers 15, and a plurality of electrode layers 19 being stacked. In the present embodiment, the number of the electrode layers 11 is "2", the number of the electrode layers 13 is "2", the number of the electrode layers 15 is "7", and the number of the electrode layers 19 is "2". The electrode layer 19 constitutes the electrode parts 5Bb and 5Bd. The electrode layer 19 is lower in height than the electrode layer 13 in the first direction. As a result, the electrode parts 5Bb and 5Bd constituted by the electrode layer 13 and the electrode layer 19 have stepped end portions on the main surface 2*c* side.

As described above, the multilayer coil component 1B according to the present embodiment is similar in action and effect to the multilayer coil component 1.

Although embodiments of the present invention have been described above, the present invention is not necessarily limited to the above-described embodiments and various modifications can be made without departing from the scope of the present invention.

Figure 11B:
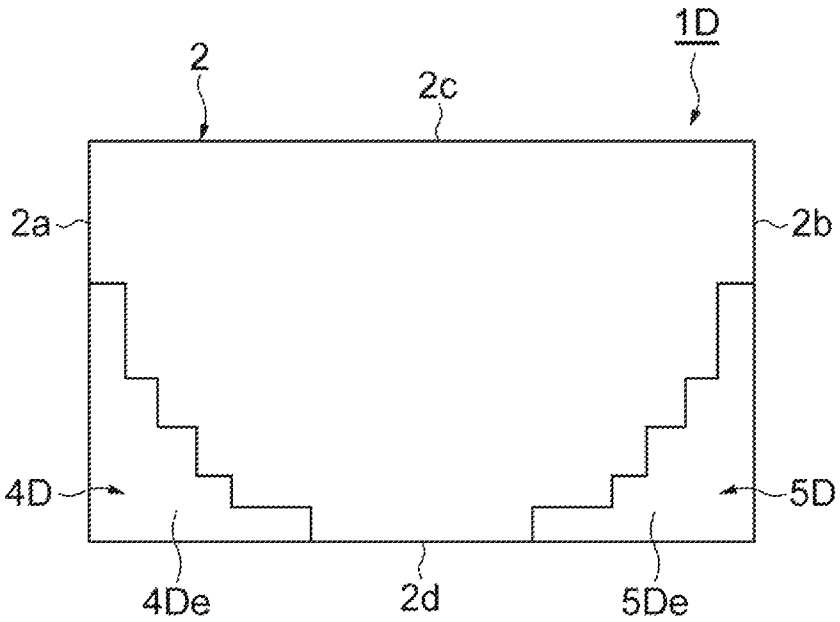
FIG. 11B is a side view illustrating the configuration of a multilayer coil component according to another embodiment.
Figure 11A:
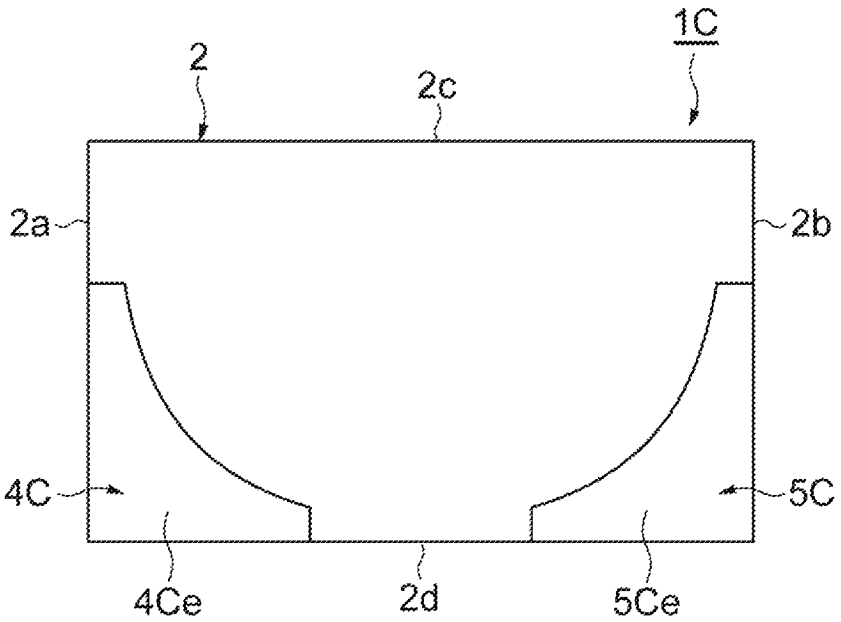
FIG. 11A is a side view illustrating the configuration of a multilayer coil component according to another embodiment.

A form in which the shapes of the electrode parts 4*a* and 4*e* (4Aa, 4Ae, 4Ba, 4Be) of the terminal electrode 4 are the shapes illustrated in FIG. 3 has been described as an example in the above embodiment. However, the shapes of the electrode parts 4*a* and 4*e* of the terminal electrode 4 are not limited thereto. For example, as illustrated in FIG. 11A, an electrode part 4Ce of a terminal electrode 4C in a multilayer coil component 1C may have a curved part. The curved part is curved in a convex shape in a direction away from the coil 8. In addition, as illustrated in FIG. 11B, an electrode part 4De of a terminal electrode 4D in a multilayer coil component 1D may have an uneven part. In such a configuration, it is possible to reduce the stray capacitance that is generated in relation to the coil 8 while ensuring a contact area with the element body 2. The same applies to an electrode part 5Ce of a terminal electrode 5C and an electrode part 5De of a terminal electrode 5D.

A form in which the coil 8 has the first coil conductor 22, the second coil conductor 23, the third coil conductor 24, the fourth coil conductor 25, and the fifth coil conductor 26 has been described as an example in the above embodiment. However, the number of the plurality of coil conductors constituting the coil 8 is not limited to the value described above.

A form in which the electrode parts 4*b* and 4*d* of the terminal electrode 4 have the first part and the second part and the electrode parts 4*b* and 4*d* have an L shape when viewed from the third direction D3 has been described as an example in the above embodiment. The first part of the electrode parts 4*b* and 4*d* as a whole may extend along the first direction D1 when viewed from the third direction D3. In addition, the second part of the electrode parts 4*b* and 4*d* as a whole may extend along the second direction D2 when viewed from the third direction D3. Accordingly, unevenness may be provided on the surfaces of the first part and the second part of the electrode parts 4*b* and 4*d* that come into contact with (face) the element body 2. The same applies to the terminal electrodes 4A and 4B and the terminal electrodes 5, 5A, and 5B.

A form in which the corner portion formed by the first part and the second part of the electrode parts 4*b* and 4*d* of the terminal electrode 4 is defined by the first part and the second part forming a substantially right angle has been described as an example in the above embodiment. However, the corner portion may be defined by a surface that curves from the first part toward the second part or may be defined by a surface that is linearly inclined from the first part toward the second part. The same applies to the terminal electrodes 4A and 4B and the terminal electrodes 5, 5A, and 5B.

What is claimed is:

1. A multilayer coil component comprising:

an element body that includes a plurality of dielectric layers that are stacked, a pair of end surfaces facing each other, a pair of main surfaces facing each other, and a pair of side surfaces, wherein the pair of side surfaces face each other in a stacking direction of the plurality of dielectric layers, and one of the pair of main surfaces is a mounting surface;

a coil in the element body an axis of the coil extending along the stacking direction; and a pair of terminal electrodes connected to the coil and respectively embedded in the element body at the pair of end surfaces, wherein each of the pair of terminal electrodes includes a plurality of electrode layers having different shapes stacked in the stacking direction and each of the pair of terminal electrodes is exposed on a respective one of the pair of end surfaces, on the mounting surface, and on the pair of side surfaces, one electrode part of the pair of terminal electrodes is exposed on one of the pair of side surfaces and formed by one of the electrode layers has an overlapping part overlapping at least a part of another electrode part formed by another of the electrode layers adjacent to the one of the electrode layers in the stacking direction and a first non-overlapping part not overlapping the other electrode part when viewed from the stacking direction, and the other of the electrode layers has a second non-overlapping part that does not overlap with the overlapping part or with the first non-overlapping part and that extends beyond the overlapping part in a direction away from the mounting surface.

2. The multilayer coil component according to claim 1, wherein the other electrode part has a first part extending along a facing direction of the pair of main surfaces and a second part extending along a facing direction of the pair of end surfaces when viewed from the stacking direction, and the first non-overlapping part includes a region corresponding to a corner portion formed by the first part and the second part when viewed from the stacking direction.

3. The multilayer coil component according to claim 1, wherein the first non-overlapping part has a part curved in a convex shape in a direction away from the coil when viewed from the stacking direction.

4. The multilayer coil component according to claim 1, wherein the first non-overlapping part has an uneven part when viewed from the stacking direction.

5. The multilayer coil component according to claim 1, wherein each of the pair of terminal electrodes and the coil do not overlap when viewed from the stacking direction.

6. The multilayer coil component according to claim 1, wherein each of the pair of terminal electrodes and the coil do not overlap when viewed from a facing direction of the pair of end surfaces.

* * * * *